US011618134B1

(12) United States Patent
Crawford

(10) Patent No.: US 11,618,134 B1
(45) Date of Patent: Apr. 4, 2023

(54) RATCHETING WRENCH APPARATUS, SYSTEM AND METHOD OF USE THEREOF

(71) Applicant: Bruce A. Crawford, Erie, CO (US)

(72) Inventor: Bruce A. Crawford, Erie, CO (US)

( * ) Notice: Subject to any disclaimer, the term of this patent is extended or adjusted under 35 U.S.C. 154(b) by 0 days.

(21) Appl. No.: 17/823,649

(22) Filed: Aug. 31, 2022

Related U.S. Application Data

(60) Provisional application No. 63/360,336, filed on Sep. 27, 2021.

(51) Int. Cl.
*B25B 13/46* (2006.01)
*B25G 1/10* (2006.01)

(52) U.S. Cl.
CPC ..... *B25B 13/463* (2013.01); *B25G 1/102* (2013.01); *B25G 1/105* (2013.01)

(58) Field of Classification Search
CPC ..... B25B 13/463; B25G 1/102; B25G 1/105
USPC ..... 81/60–63.2
See application file for complete search history.

(56) References Cited

U.S. PATENT DOCUMENTS

| | | | | |
|---|---|---|---|---|
| 1,793,714 | A * | 2/1931 | Newberg | B25B 13/08 81/177.1 |
| 3,866,492 | A | 2/1975 | Knoll | |
| 3,979,965 | A | 9/1976 | Vuceta | |
| 4,507,990 | A * | 4/1985 | Lack | B25B 13/467 81/57.39 |
| 5,782,147 | A * | 7/1998 | Chaconas | B25B 13/463 192/43.1 |
| 6,886,430 | B1 | 5/2005 | Tremblay et al. | |
| 7,000,504 | B2 | 2/2006 | Chen | |
| 7,380,481 | B2 | 6/2008 | Barnett et al. | |
| 8,205,529 | B1 | 6/2012 | Laurie | |
| 8,539,864 | B1 | 9/2013 | Kennedy | |
| 9,138,876 | B2 | 9/2015 | Cullison | |
| 10,040,188 | B2 * | 8/2018 | Huang | B25B 13/463 |
| 11,040,433 | B1 * | 6/2021 | Terry, Jr. | B25G 1/005 |
| 2005/0000328 | A1 * | 1/2005 | Hsien | B25B 13/04 81/170 |
| 2017/0197300 | A1 | 7/2017 | Lin | |

FOREIGN PATENT DOCUMENTS

| | | | |
|---|---|---|---|
| WO | 1997002928 | A1 | 1/1997 |
| WO | 2018208321 | A1 | 11/2018 |

* cited by examiner

*Primary Examiner* — Hadi Shakeri
(74) *Attorney, Agent, or Firm* — Voz Patents, LLC

(57) ABSTRACT

The present invention surrounds to a ratchet apparatus, system and use thereof. The invention is presented to provide additional mechanical advantage and added angular engagement of a ratcheting wrench. In particular the present invention provides increased torque and angular engagement within a compact space without requiring an extended handle, wherein an extended handle reduces portability and further restricts access and movement within confined spaces.

9 Claims, 14 Drawing Sheets

FIG. 2A
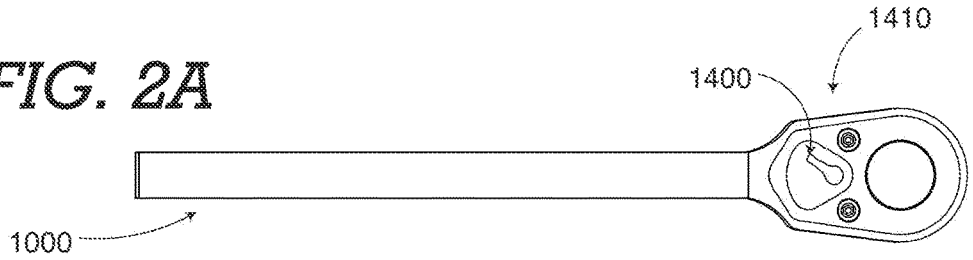
FIG. 2B
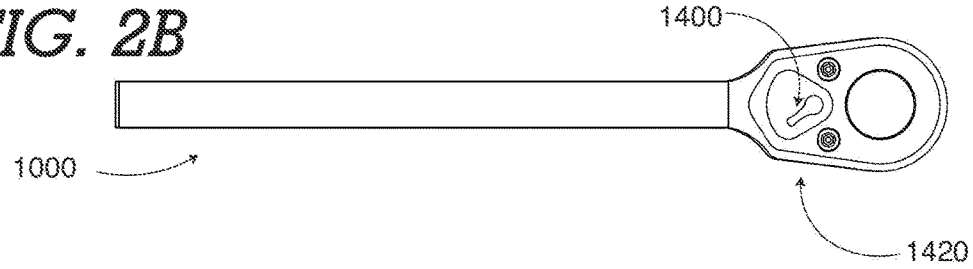
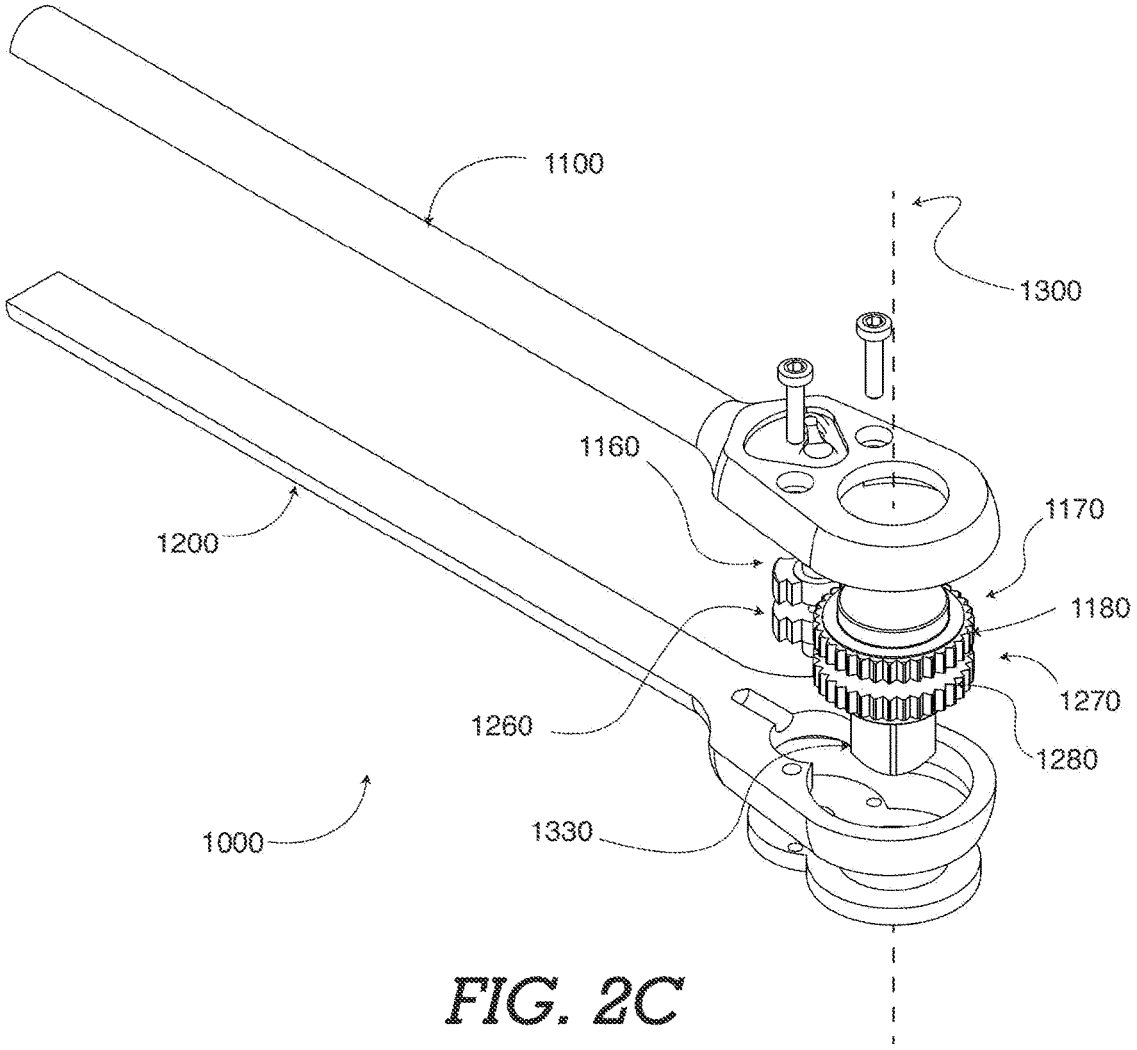
FIG. 2C

RATCHETING WRENCH APPARATUS, SYSTEM AND METHOD OF USE THEREOF

CROSS REFERENCE TO RELATED APPLICATIONS

This application claims the benefit of U.S. Provisional Patent Application 63/360,336 entitled "ADAPTOR FOR MAKING A COMPOUNDABLE RATCHET, A COMPOUND RATCHET AND A DUAL HANDED CO-AXIAL COMPOUND RATCHET. EITHER MADE SEPARATELY OR PART AS OF A TORQUE MEASURING AND/OR LIMITING DEVICE." filed on Sep. 27, 2021, the entire contents of which is incorporated herein by reference in its entirety for all purposes.

FIELD OF THE INVENTION

The present invention is directed to a ratchet apparatus, system and use thereof. The disclosed invention surrounds a ratcheting apparatus used independently or in concert with additional tools in a system. The present invention is intended to provide a user with a ratcheting tool wherein the user is provided increased torque application through the use of two hands while maintaining the ability for use within tight or confined spaces wherein an extension bar or breaker bar would not suffice independently.

BACKGROUND OF THE INVENTION

The use of ratcheting tools are common in the field of machine and car maintenance and production. A ratcheting wrench allows a user an increased efficiency when installing or removing a threaded fastener. Without a ratcheting wrench, a user may use a wrench such as a standard box wrench wherein the user connects the wrench to the fastener, turns the wrench a certain angle in the direction desired—clockwise to tighten the fastener, and counter-clockwise to loosen the fastener—and then remove the wrench from the fastener to reset the position of the wrench on the fastener again move the wrench in the desired position. This process is particularly tedious and inefficient in a confined space where connecting to the fastener is difficult and the angle which the wrench can be turned is limited. A ratcheting mechanism is used to selectively apply torque in a first rotative to tighten or loosen a fastener, while slipping in a second rotative direction to allow the resetting of the tool. The selective application of torque allows the user to swing the wrench handle clockwise and counter-clockwise without the need to remove the tool from the fastener to reset. In a first configuration a ratcheting wrench is designed to engage with and turn the fastener in a clockwise direction, and allow the user to swing the wrench handle in a counter-clockwise rotation to reset the wrench without disengaging with the fastener or rotating the fastener in the counter-clockwise direction. Similarly, in a loosening configuration the ratcheting wrench is designed to engage with and turn the fastener in a counter-clockwise rotation, and allow the user to freely swing the wrench handle in a clockwise rotation to reset the wrench without disengaging with the fastener.

While the use of ratchets is beneficial within confined spaces to address the limitations in range of motion and the angle which a wrench can swing, ratchets do not address the challenges associated with providing sufficient leverage for the removal of tightening of a fastener in a confined space. The more a ratchet is adapted for use in confined spaces, the more the handle length is limited, thus limiting the mechanical advantage for applying torque to a threaded fastener.

There is an identified need for a tool which allows the use of a ratcheting tool which provides an increased mechanical advantage while permitting use within a confined space. It is a further identified need of the present invention to enable a user to apply torque to a fastener in a loosening or tightening rotational direction with two hands working in concert with two levers interconnected to a single tool.

SUMMARY OF THE INVENTION

It is an aspect of the present invention to provide an apparatus or system which allows the interconnection of a first ratcheting handle and a second ratcheting handle to a fastener for the advancement or removal of the fastener, wherein the action of the handles each provide a ratcheting action of the selective application of torque to a fastener. Embodiments such as those comprising an adaptor allowing the interconnection of a first ratcheting wrench and a second ratcheting wrench, a ratcheting wrench comprising two handles which can be operated independently of each other, a ratcheting wrench comprising a single handle configured to be separated for independent use, a ratcheting socket wrench having two independently ratcheting handles, or a system of two ratcheting box wrenches configured to work in concert to loosen a single fastener, are within the spirit and scope of the present invention. While embodiments described herein are referred to as having a ratchet or ratcheting ability, embodiments comprising a handle which allows the selective application of torque in a first direction while allowing rotation in a second direction between the tool and a fastener are within the spirit and scope of the present invention. The meaning term "ratchet" or "ratcheting" as referred to herein surrounds the common and ordinary meaning, as well as any mechanism which restricts rotational motion in a first direction for the application of torque in the first rotational direction, while allowing rotation in a second rotational direction.

Currently existing ratcheting wrenches include: U.S. Pat. No. 1,957,462 to Kress ("Kress"), U.S. Pat. No. 4,328,720 to Shiel ("Shiel"); U.S. Pat. No. 5,626,062 to Colvin ("Colvin"); U.S. Pat. No. 4,280,379 to Chow ("the '032 Patent"); U.S. Pat. No. 4,762,032 to Chow ("the '032 Patent"); U.S. Pat. No. 4,762,033 to Chow ("the '033 Patent"); U.S. Pat. No. 5,144,869 to Chow ("the '869 Patent"); U.S. Pat. No. 4,520,697 to Moetteli ("Moetteli"); U.S. Pat. No. 3,337,014 to Sandrick ("Sandrick"); U.S. Pat. No. 2,982,161 to Fred et al. ("Fred"); U.S. Pat. No. 6,568,299 to Hu ("Hu"); U.S. Pat. No. 4,748,875 to Lang ("Lang"); each of which are incorporated by reference herein in their entirety for all purposes.

It is an aspect of the present invention to provide an adaptor which allows the interconnection of ratcheting socket wrench and a ratcheting box wrench thereto to work in concert to tighten or loosen a threaded fastener. The adaptor comprises a hexagonal aspect or other shaped outer profile allowing the interconnection of a ratcheting wrench, and a square-drive recess at one end which is configured for the interconnection of a ratcheting socket wrench. A second end of the adaptor comprises a square-drive tang adapted for interconnection with a wrench socket. Thus, the interconnection of a ratcheting socket wrench and a ratcheting box wrench allows the two handles to be used in concert. Although embodiments disclosed and shown herein surround ratcheting wrenches having a square-drive tang and square-drive recess, embodiments comprising a drive tang of an alternate profile or a drive recess of an alternate profile, are within the spirit and scope of the present invention. Such profiles include, but are not limited to lobed profiles, splined profiles, hexagonal profiles, or other polygonal profiles.

It is an aspect of the present invention to allow a user to double the mechanical advantage for applying torque to a fastener. While efforts to double mechanical advantage typically surround the doubling of a wrench handle length in order to double the lever-arm of a wrench, doubling a wrench handle length can limit the use of the wrench in confined spaces and results in a heavy and bulky tool which is difficult to transport. Certain embodiments comprise a ratcheting wrench comprising first wrench handle and a second wrench handle wherein the wrench handles are configured to be used independently. A user can place one hand on the first wrench handle, and a second hand on the second handle to rotate both handles in a first direction, thereby increasing the torque which they can apply to a fastener without requiring an increased handle length.

When using a standard ratcheting wrench, the advancing or removal of a threaded fastener requires the wrench handle to be alternatingly rotated in a first direction in a first step wherein the fastener is rotated, and then rotated in a second direction in a second step wherein the wrench angle is reset. In such a use, the fastener is only rotated during one out of two steps. It is a further aspect of the present invention to allow a user to increase the rate in which they are able to advance or remove a fastener, particularly when increased mechanical advantage is no longer necessary. In certain scenarios, a user may prefer to use the two wrench handles alternatingly to advance or remove a threaded fastener with increased speed rather than increased torque. In such a scenario, each wrench handle comprises a ratcheting capability wherein the wrench handles are configured to apply torque in a first rotational direction, while allowing rotation in a second rotational direction. Thus, in a first step the user alternatingly rotates the first wrench handle in the first direction to rotate the threaded fastener while simultaneously rotating the second wrench in the second direction to reset the wrench handle angle, and in a second step the user rotates the first wrench handle in the second direction to reset the wrench handle angle while rotating the second handle in the first direction to rotate the threaded fastener. Accordingly, the fastener is advanced both during the first step and the second step, thus increasing the rate at which the fastener is advanced or removed.

It is an aspect of certain embodiments to provide the flexibility to use a wrench of certain embodiments as a standard single handled wrench, or double-handled ratcheting wrench. In certain embodiments, a ratcheting wrench comprises two handles which are capable of operating independently of each other in a first configuration, and wherein the handles can be used in concert in a second configuration. The handles of certain embodiments comprise a handle longitudinally split into two handles, wherein the handles are configured to nest together into a unitary form for use in as a single-handed wrench, and wherein the handles can be split for use as a wrench having two handles. In certain embodiments a handle is longitudinally split wherein the split is planar, in alternate embodiments the longitudinal split comprises a helical path, however the longitudinal split is not restricted thereto. Alternate embodiments comprising longitudinal splits between two wrench handles, wherein the handles are configured to be nest for use as a single handle, and wherein the handles are configured to be split for use independently are within the spirit and scope of the present invention.

In further embodiments, a ratcheting wrench comprises a first handle comprising a recess wherein a second handle can be stored for single-handled use, and wherein the second handle can be rotated out of the recess and away from the single handle for double-handle use when desired.

It is an aspect of the present invention to allow increased control of a ratcheting wrench to maintain engagement with a threaded fastener. In certain embodiments of the present invention comprising a ratcheting wrench comprising a first handle and a second handle, a user can keep the first handle static to maintain engagement with the threaded fastener, and rotate the second handle alternatingly in the first direction and the second direction to rotate the threaded fastener as desired.

Existing ratchet wrenches typically employ a ring gear or ratchet drive gear which have 24-100 teeth over a 360-degree range, which directly correlates to the number of degrees of engagement. A ratchet drive gear or ring gear comprising 24 teeth for instance, resulting in a low angular engagement requiring 15-degrees of wrench handle swing to reset the wrench by a single tooth. In contrast, a ring gear or ratchet drive gear comprising 100 teeth requires only 3.6 degrees of wrench handle swing to reset the wrench by a single tooth. A higher number of teeth results in increased angular engagement, wherein a lower the angle that is required to reset the ratcheting wrench to apply torque to a fastener. Increased angular engagement is particularly important in tight spaces wherein the range which a user can swing a wrench handle to reset the wrench handle angle. It is an aspect of the present invention to provide increased angular engagement wherein the angular displacement required to reset the ratcheting wrench by at least one tooth is decreased. In certain embodiments a ratcheting wrench comprises two handles, each handle being interconnected with an independent ratcheting mechanism comprising a ring gear or ratchet drive gear. The ratcheting mechanisms of the first ratcheting mechanism and the second ratcheting mechanism are angularly offset from each other by a half-tooth, wherein when the handles are used in concert as a single handle, the angular engagement is doubled wherein the angular displacement necessary to reset the handle by a single tooth is reduced by half. Thus, if the ratcheting mechanisms comprise 24 teeth, the wrench requires only 7.5-degrees of wrench handle swing to reset the wrench by a single tooth, and in the case of the ratcheting mechanisms comprising 100 teeth, resetting the wrench by a single tooth requires only 1.8-degrees of wrench handle swing.

It is an aspect of the present invention to provide a ratcheting wrench wherein a first side of the head of the ratcheting wrench is configured to interconnect with a threaded fastener directly or with a socket for engagement with the threaded fastener, and a second side of the head wrench is configured to interconnect with a second wrench. In certain embodiments the first side of the head of the ratcheting wrench comprises a square-drive tang for interconnecting to a socket, and the second side of the head of the ratcheting wrench comprises a square-drive recess for receiving the square-drive tang of a second ratcheting wrench. Thus, two ratcheting wrenches can be interconnected to a single threaded fastener, thus doubling the available mechanical advantage for a user.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1A:
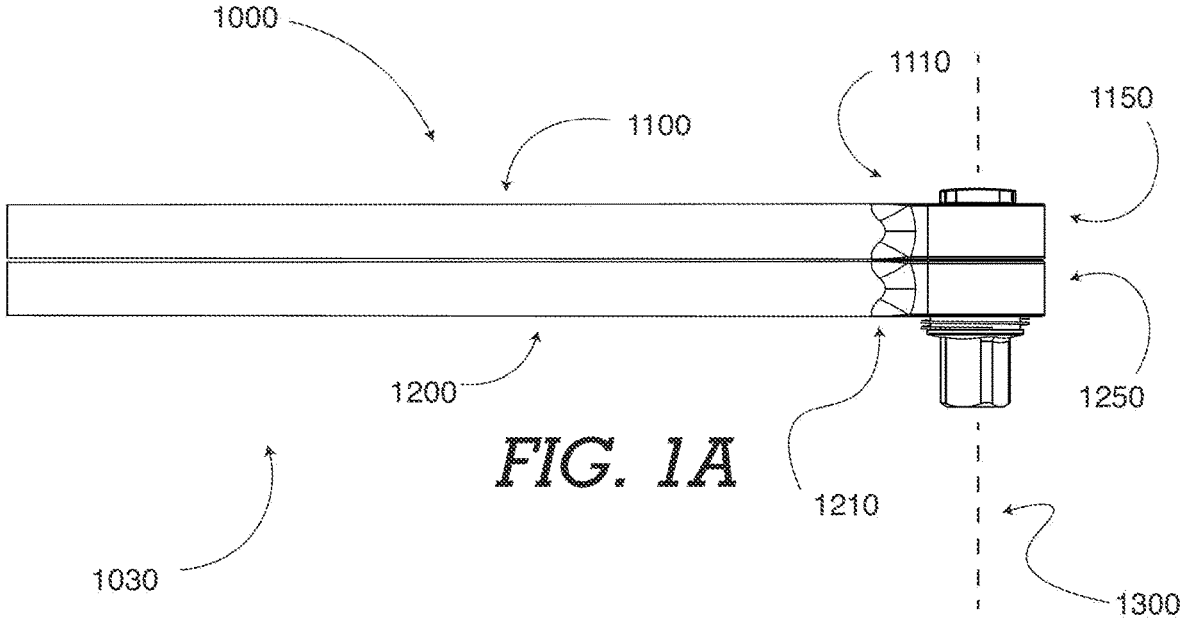
FIG. 1A—A side view of certain embodiments of the present invention comprising a two-handled ratcheting wrench FIG. 1B—A perspective view of certain embodiments of the present invention comprising a two-handled ratcheting wrench FIG. 1C—An exploded perspective assembly view of certain embodiments of the present invention comprising a two-handled ratcheting wrench FIG. 1D—A top view of certain embodiments of the present invention comprising a two-handled ratcheting wrench FIG. 2A—A top view of certain embodiments of the present invention comprising a two-handled ratcheting wrench FIG. 2B—A top view of certain embodiments of the present invention comprising a two-handled ratcheting wrench FIG. 2C—An exploded perspective view of certain embodiments of the present invention comprising a two-handled ratcheting wrench FIG. 3A—An exploded side view of certain embodiments of the present invention comprising a two-handled ratcheting wrench FIG. 3B—An exploded perspective view of certain embodiments of the present invention comprising a two-handled ratcheting wrench FIG. 4A—A side view of certain embodiments of the present invention comprising a two-handled ratcheting wrench FIG. 4B—A perspective view of certain embodiments of the present invention comprising a two-handled ratcheting wrench FIG. 4C—A perspective view of certain embodiments of the present invention comprising a two-handled ratcheting wrench FIG. 5A—A top view of certain embodiments of the present invention comprising a two-handled ratcheting wrench wherein the handles comprise a longitudinal twist FIG. 5B—A rear view of certain embodiments of the present invention comprising a two-handled ratcheting wrench wherein the handles comprise a longitudinal twist FIG. 5C—A perspective view of certain embodiments of the present invention comprising a two-handled ratcheting wrench wherein the handles comprise a longitudinal twist FIG. 5D—A perspective view of certain embodiments of the present invention comprising a two-handled ratcheting wrench wherein the handles comprise a longitudinal twist FIG. 6A—A side view of certain embodiments of the present invention comprising a two-handled ratcheting wrench FIG. 6B—A top view of certain embodiments of the present invention comprising a two-handled ratcheting wrench FIG. 6C—A perspective view of certain embodiments of the present invention comprising a two-handled ratcheting wrench FIG. 6D—A top view of certain embodiments of the present invention comprising a two-handled ratcheting wrench FIG. 7A—A perspective view of certain embodiments of the present invention comprising a two-handled ratcheting wrench FIG. 7B—A perspective view of certain embodiments of the present invention comprising a two-handled ratcheting wrench FIG. 8A—A perspective view of certain embodiments of the present invention comprising a first ratcheting mechanism and a second ratcheting mechanism FIG. 8B—A side view of certain embodiments of the present invention comprising a first ratcheting mechanism and a second ratcheting mechanism FIG. 8C—A section view the embodiment shown in FIG. 8B FIG. 8D—A section view the embodiment shown in FIG. 8B FIG. 9A—A top view of certain embodiments of the present invention comprising a compound ratcheting wrench FIG. 9B—A side view of certain embodiments of the present invention comprising a compound ratcheting wrench FIG. 9C—An exploded perspective assembly view of certain embodiments of the present invention comprising a compound ratcheting wrench FIG. 10A—A perspective view of certain embodiments of the present invention comprising an adaptor FIG. 10B—A perspective view of certain embodiments of the present invention comprising an adaptor
Figure 1B:
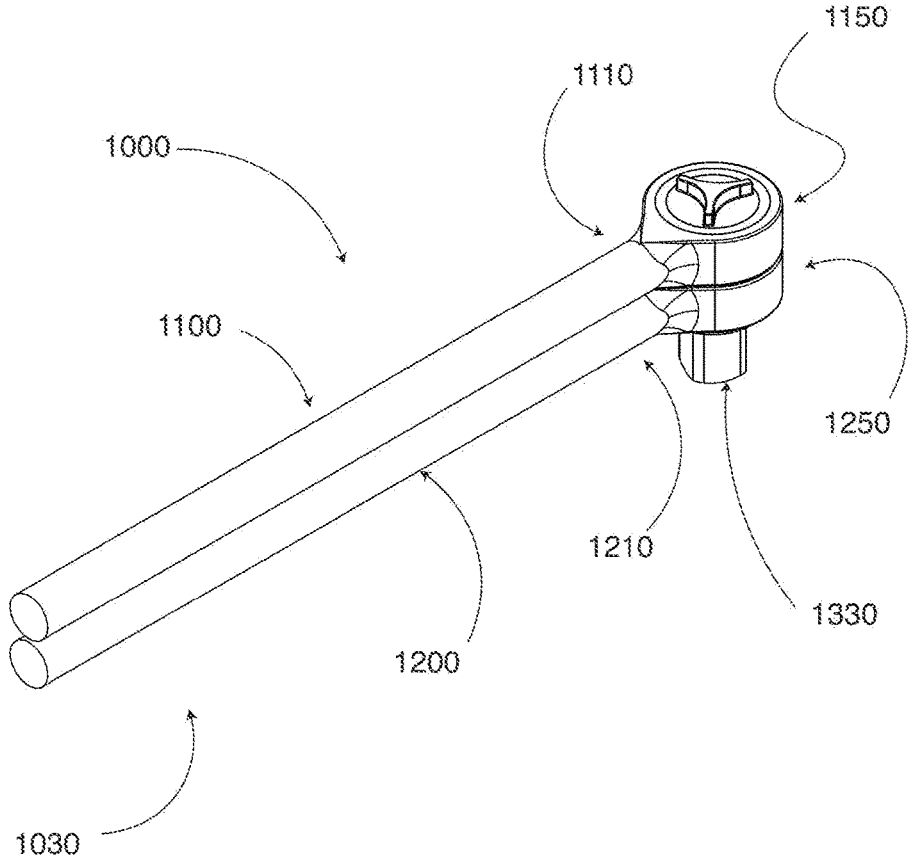
Figure 1C:
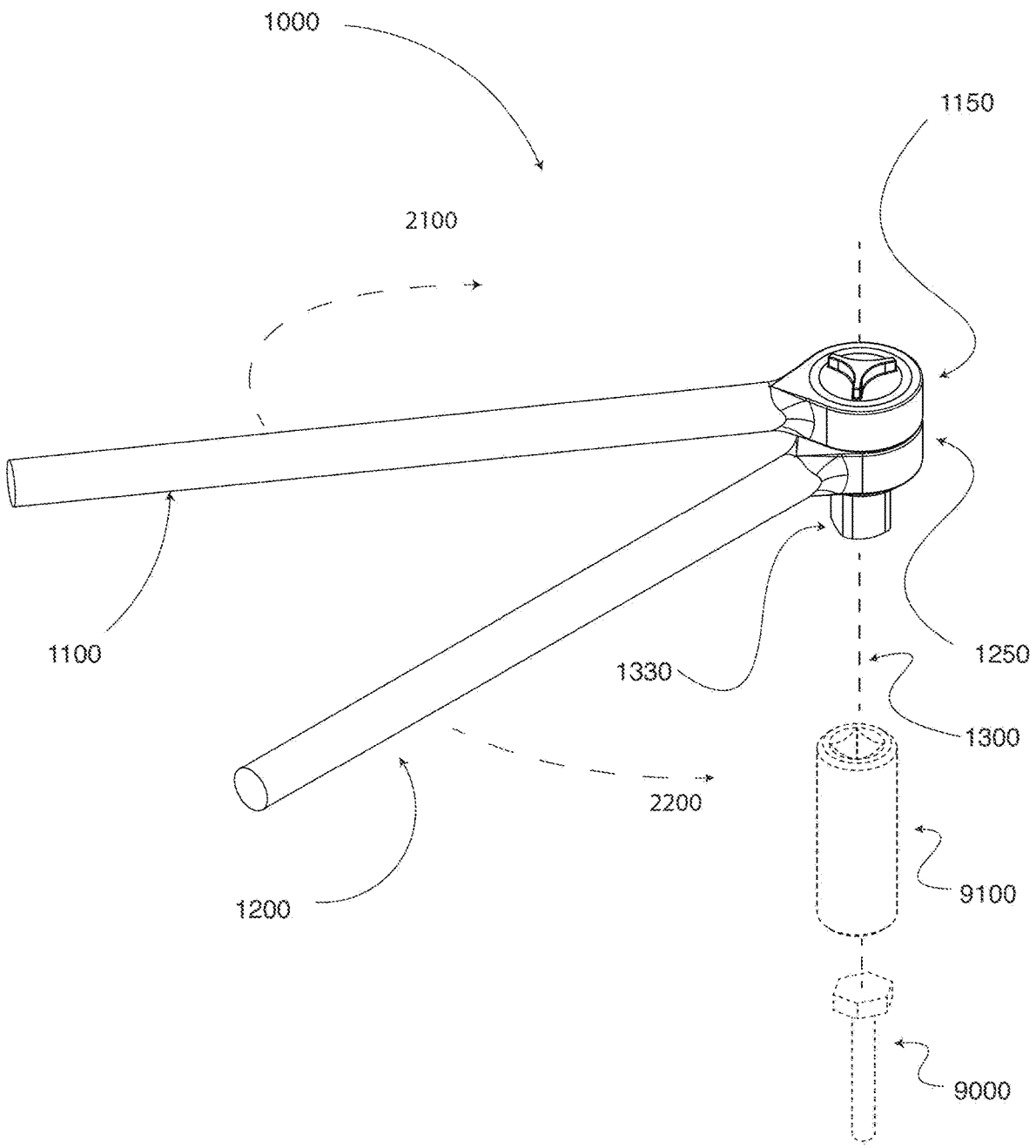
Figure 1D:
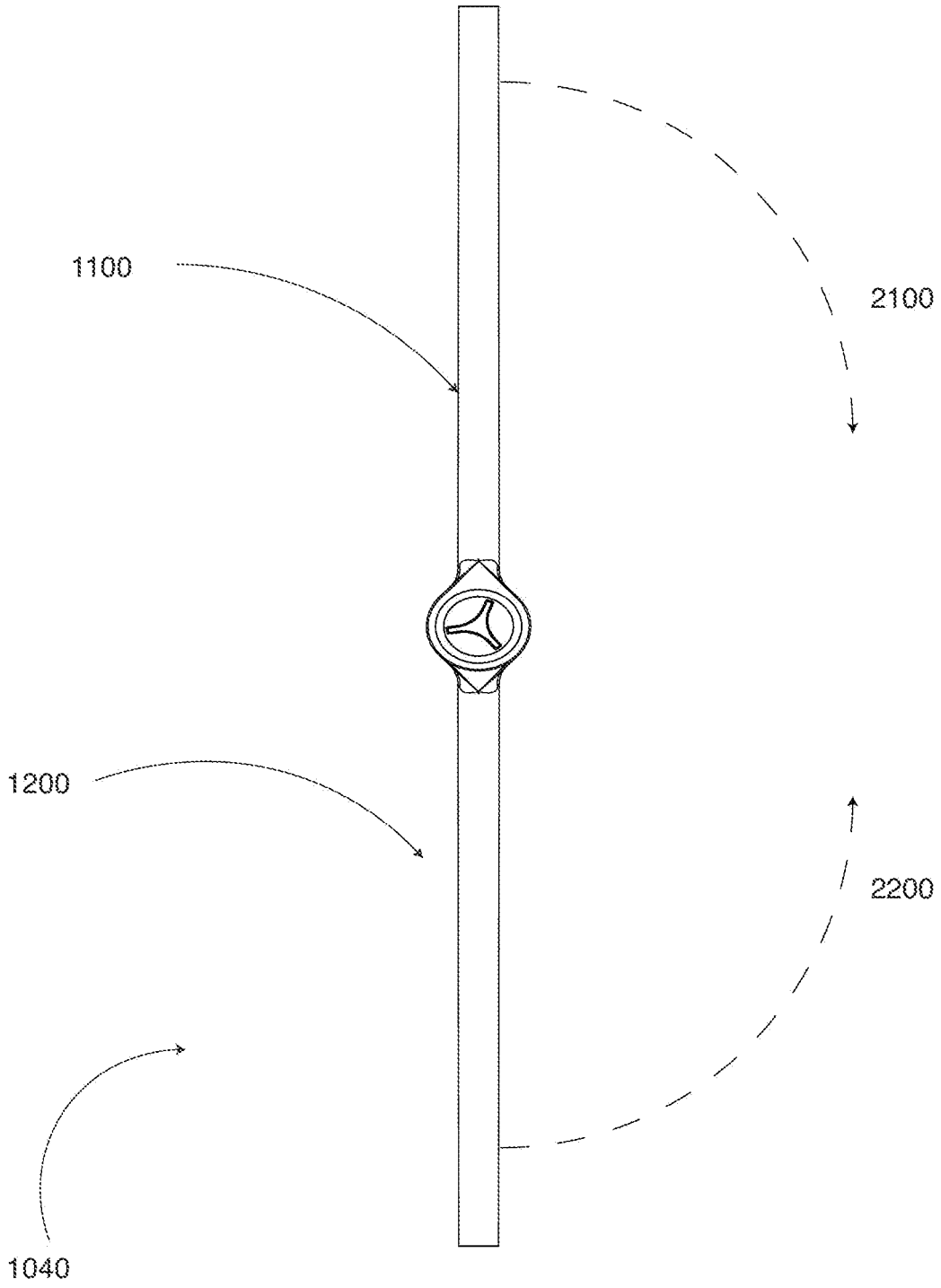

Certain embodiments of the present invention, as shown in FIG. 1A-FIG. 1D for instance, comprise a ratcheting wrench 1000 comprising a first handle 1100 and a second handle 1200 which are configured to be used in concert as a unitary handle, or separately as independent handles. The first handle 1100 has a first end 1110 interconnected to a first ratcheting mechanism 1150 and the second handle 1200 has a first end 1210 interconnected to a second ratcheting mechanism 1250. While a ratcheting mechanism as taught herein surrounds a mechanism comprising geared element and a pawl configured to selectively allow rotation between elements in a first direction and restrict rotation in a second direction, embodiments comprising a non-geared element and an interfacing elements configured to selectively allow rotation between elements in a first direction and restrict rotation in a second direction are within the spirit and scope of the present invention.

The first end of the first handle 1100 is interconnected with a first ratcheting mechanism 1150, and a first end 1210 of the second handle is interconnected with a second ratcheting mechanism 1250. The first ratcheting mechanism 1150 and the second ratcheting mechanism 1250 comprise a drive axis 1300 which is coaxial with a ratcheting wrench is intended to apply a moment—or torque—to a threaded fastener 9000. The first ratcheting mechanism 1150 is configured to allow rotation between the first ratcheting mechanism 1150 and the first handle in a first direction 2100 about the drive axis 1300, and restrict rotation between the first ratcheting mechanism 1150 and the first handle 1100 in a second direction 2200 about the drive axis 1300. Similarly, the second ratcheting mechanism 1250 is configured to allow rotation between the second ratcheting mechanism 1250 and the second handle 1200 in a first direction 2100 about the drive axis 1300, and restrict rotation between the second ratcheting mechanism 1250 and the second handle 1200 in a second direction 2200 about the drive axis 1300.

In certain embodiments the first ratcheting mechanism 1250 and the second ratcheting mechanism 1250 are coaxially interconnected coaxially along the drive axis 1300 wherein the first ratcheting mechanism 1150 and the second ratcheting mechanisms 1250 are configured to rotate independently of each other. When used in concert as one unitary handle, the first handle 1100 and the second handle 1200 are aligned in an aligned configuration 1030, and both handles can be grasped by a single hand for the application of torque. When used independently, the handles are in a misaligned configuration 1040 and a user places one hand on a first handle 1100 and a second hand on the second handle 1200. The handles can be rotated simultaneously in the same direction—the first direction 2100 or the second direction 2200—to assist in providing increased mechanical advantage allowing a user to apply more torque to a threaded fastener 9000 to tighten or loosen it, and then rotate both handles in the alternate direction to reset the handles. Alternatively, when used independently, the first handle 1100 and the second handle 1200 can be used simultaneously by alternatingly rotating the first handle 1100 in the first direction 2100 to apply torque to a threaded fastener 9000 while rotating the second handle 1200 in the second direction 2200 to reset the position of the second handle 2200 in a first step. Subsequently, in a second step the first handle 1100 is rotated in the second direction 2200 to reset the first handle 1100 while the second handle 1200 is rotated in the first direction 2100 to apply torque to the fastener. Accordingly in each step the threaded fastener 9000 is rotated allowing the removal or advancing of a threaded fastener 9000 twice as rapidly as single-handed use would allow.

Figure 3A:
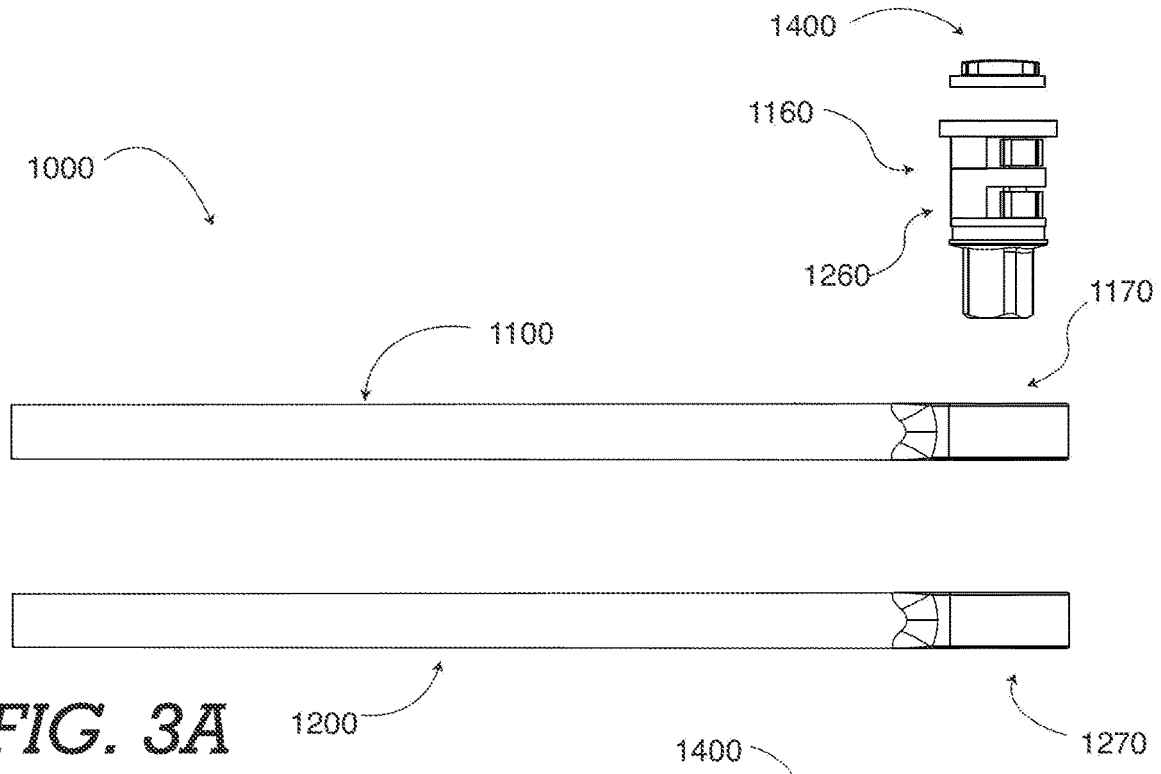
Figure 3B:
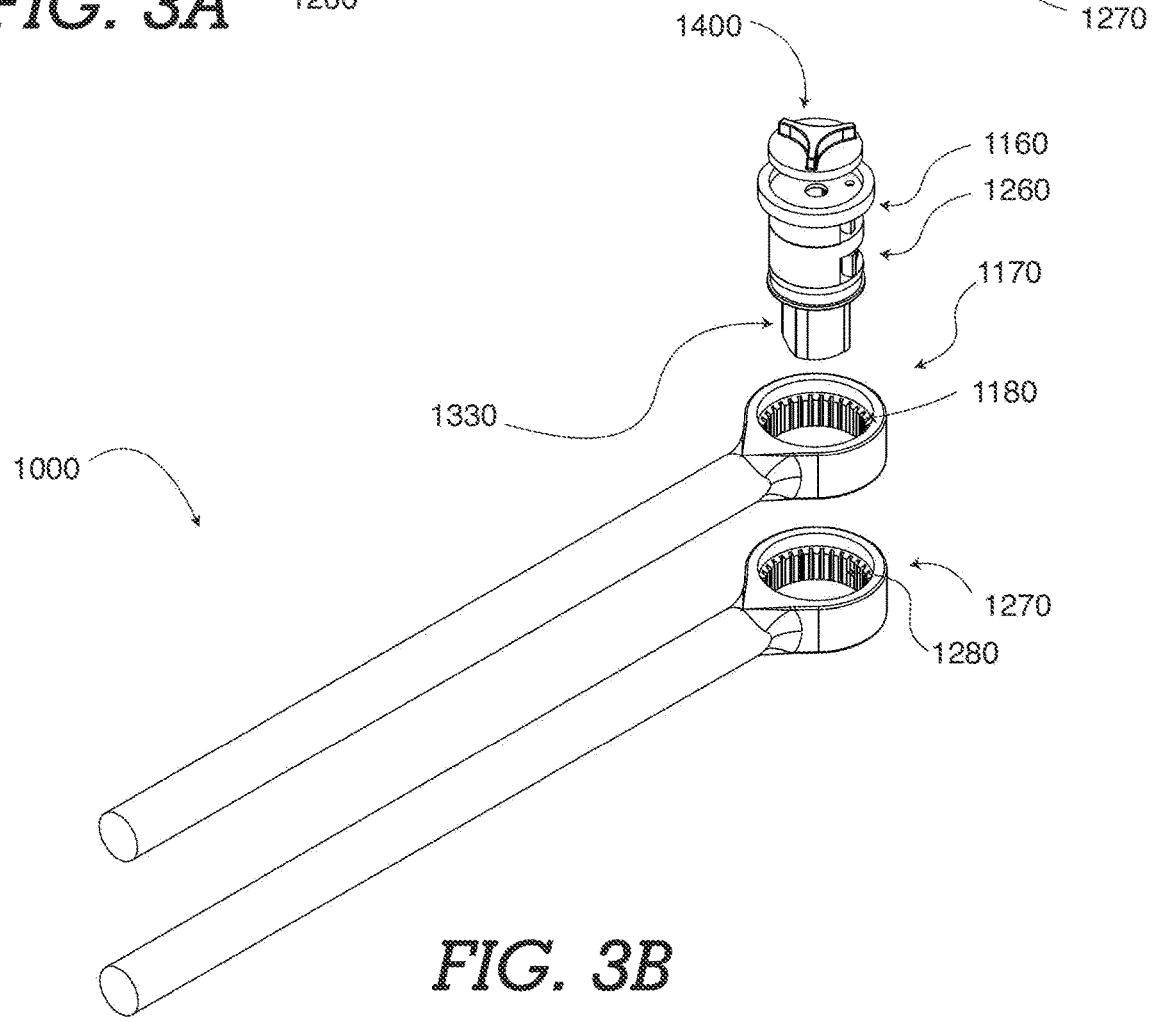

In certain embodiments, as shown in FIG. 2A-FIG. 3B for instance, a reversing lever 1400 is configured to control the orientation of a pawl 1160 within the ratcheting mechanism 1150 which is configured to allow rotation of a handle 1100 around a drive axis 1300 in relation to a ratchet wheel 1170 in a first direction, but restrict the rotation of the handle 1100 around the drive axis 1300 in relation to a ratchet wheel 1170 in a second direction 2200. Embodiments disclosed herein include those, such as shown in FIG. 2A-FIG. 2C, that comprise a ratcheting mechanism 1150 having ratchet wheel 1170 that comprises gear teeth 1180 wherein the ratchet wheel 1170 rotates independently of the handle 1100 and the pawl 1160 rotates with the handle 1100. Alternative embodiments, such as shown in FIG. 3A-FIG. 3B and taught by Kress, comprising a handle 1100 having a housing 1130 at a first end 1100 comprising a drive ring 1190 comprising gear teeth 1180 which rotate with the handle 1100 such as taught by the '379 Patent, wherein the pawl 1160 rotates independently of the handle 1100 are within the spirit and scope of the present invention.

In certain embodiments comprising two handles 1100, 1200 each with their own ratcheting mechanism 1150,1250, a single reversing lever 1400 is configured to control the orientation of a first pawl 1160 within the first ratcheting mechanism 1150, and the orientation of a second pawl 1260 within the second ratcheting mechanism 1250. As such, placing the reversing lever 1400 in a first orientation 1410 allows the rotation of the handles in a first direction 2100 in relation to the ratcheting mechanisms while restricting rotation in the second direction 2200, and placing the reversing lever 1400 in a second orientation 1420 allows the rotation of the handles in the second direction 2200 in relation to the ratcheting mechanisms and restricting rotation 2100 in the first direction.

In certain embodiments, as shown in FIG. 1A-FIG. 3B for instance, a square-drive tang 1330 extends away from the ratcheting mechanisms 1150,1250 wherein the square-drive tang 1330 is adapted for interconnecting with a wrench socket 9100 and applying torque thereto to rotate a threaded fastener 9000. While embodiments described herein surround the use of a square-drive ratcheting wrench in accordance with American Standards Association (ASA) B5.38-1958, alternate embodiments employing alternate drive methods including a spline drive such as disclosed by Colvin and Moetteli, or a ratcheting box wrench as disclosed by Lang, are within the spirit and scope of the present invention. In certain embodiments the square-drive tang 1330, or alternate drive method, rotates coaxially with the ratcheting mechanisms 1150, 1250 and the drive axis 1300.

Figure 4A:
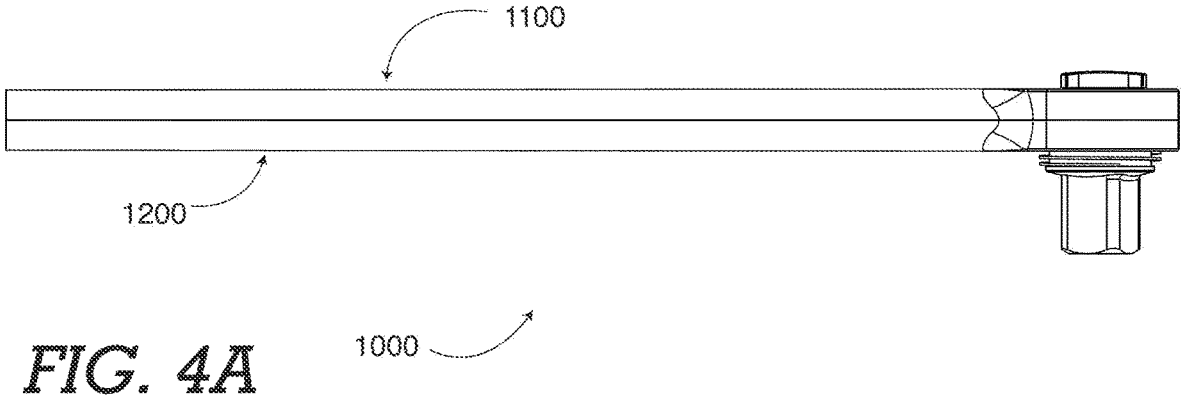
Figure 4B:
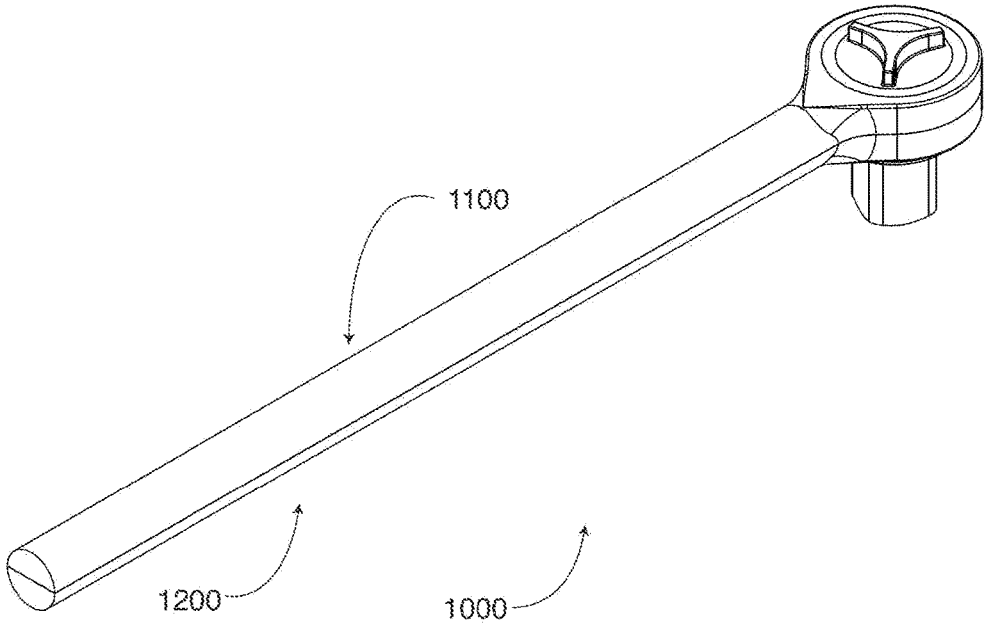
Figure 4C:
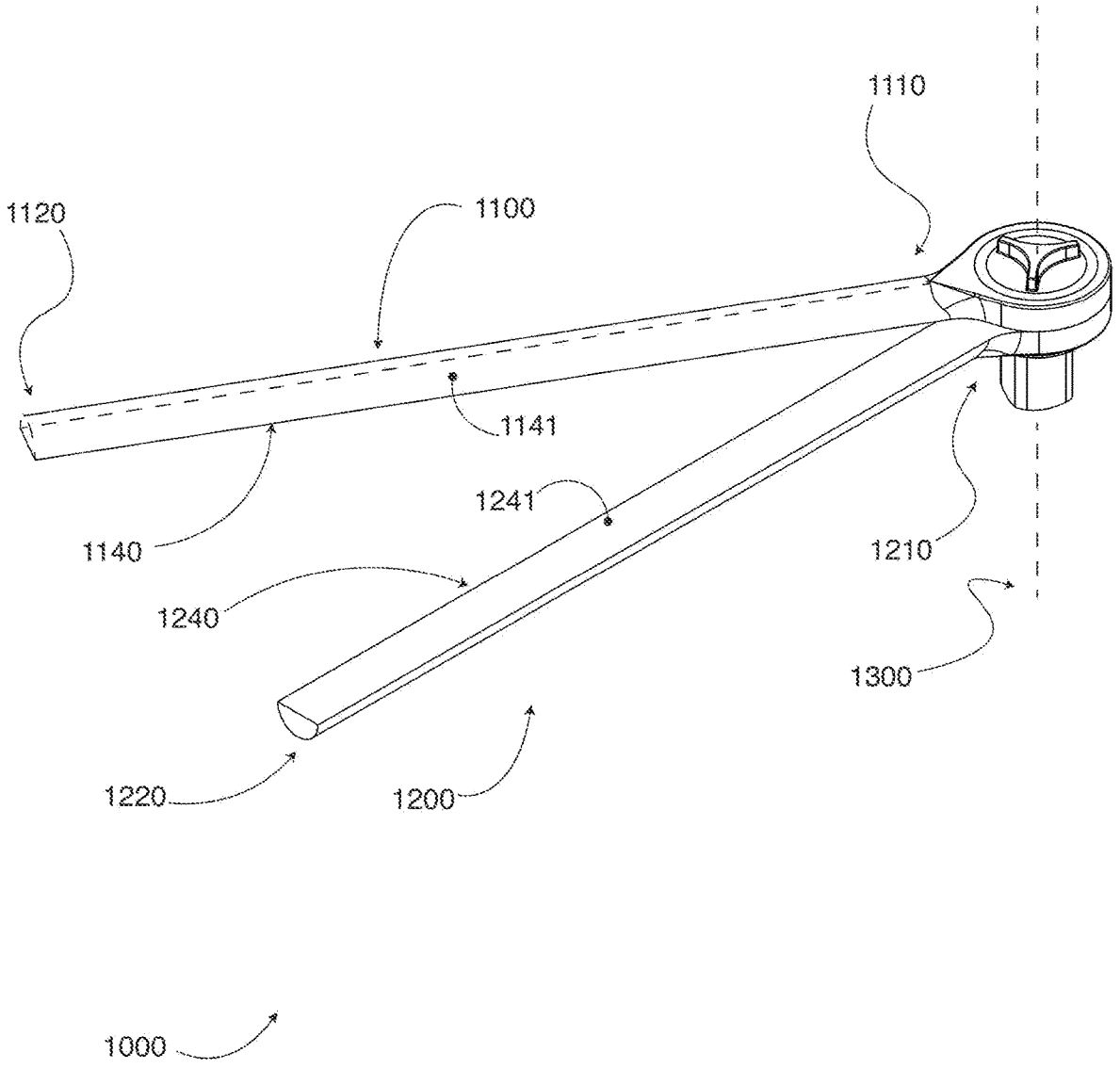
Figure 5A:
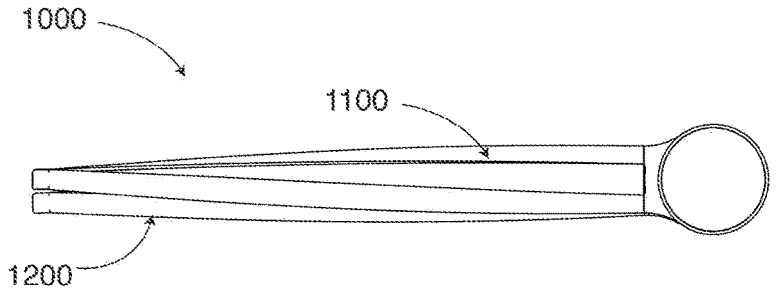
Figure 5B:
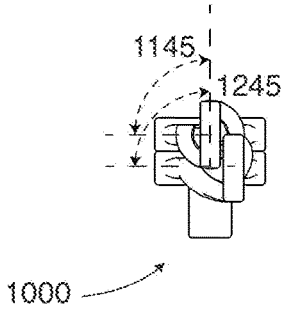
Figure 5C:
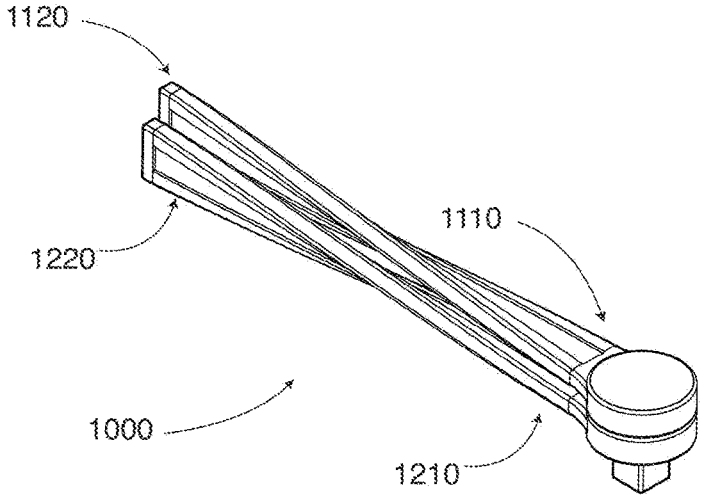
Figure 5D:
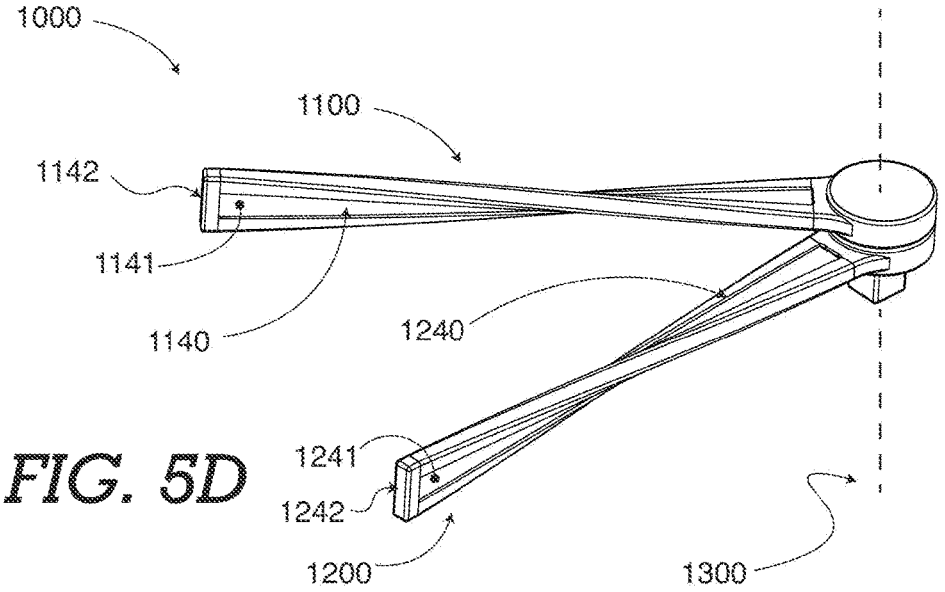
Figure 6A:
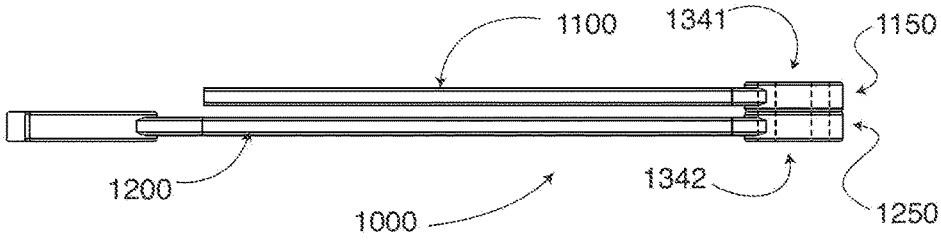
Figure 6B:
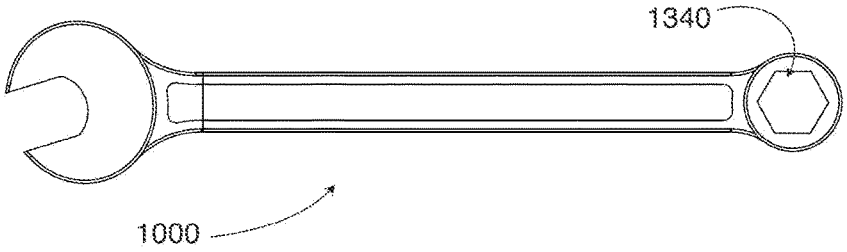
Figure 6C:
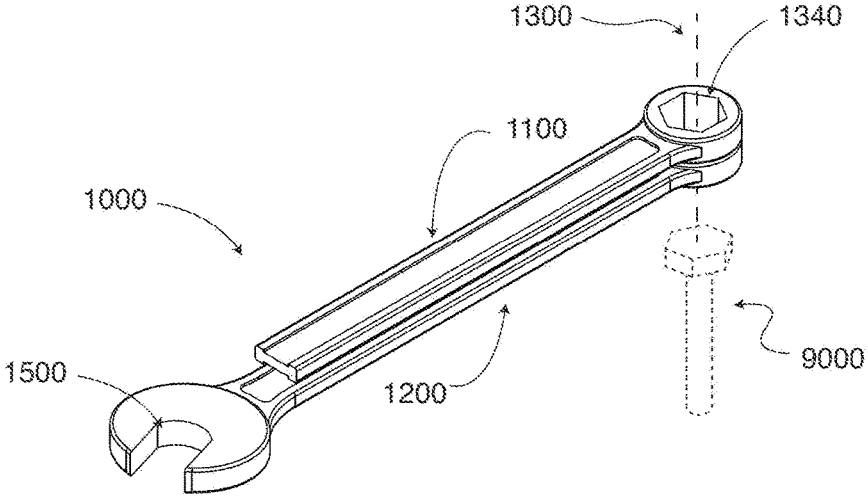
Figure 6D:
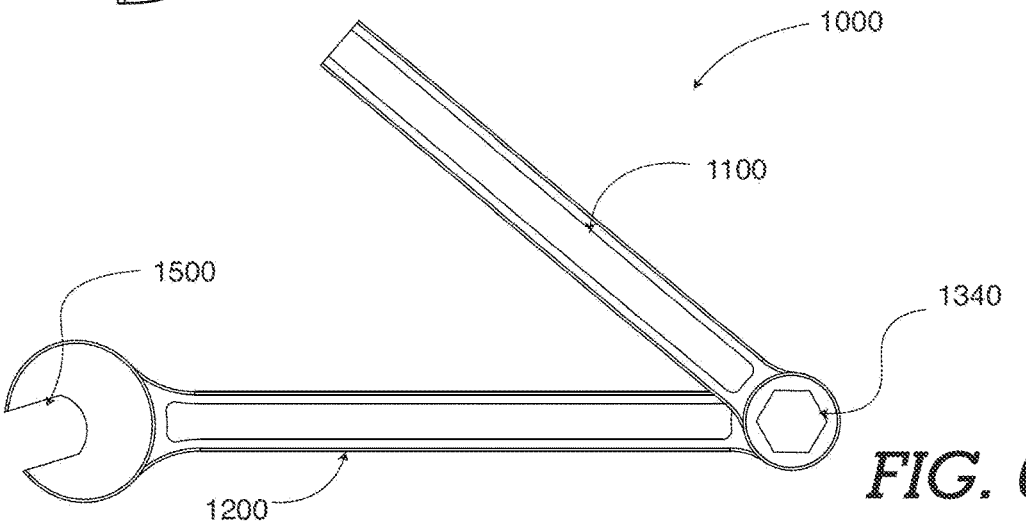

In certain embodiments of the present invention comprising two handles 1100, such as shown in FIG. 4A-FIG. 4C, the first handle 1100 comprises an interfacing surface 1140 configured to interconnect with an interfacing surface 1240 of the second handle when the handles are in an aligned configuration 1030. The handles are configured to interconnect or nest together to form a unitary form when the handles are aligned. In certain embodiments at least a portion of each of the interfacing surfaces 1140,1240 are perpendicular to the drive axis 1300 of the ratcheting mechanism. In certain embodiments the interfacing surfaces 1140,1240 each comprise planar surface 1141,1241 between the first ends of the handles 1110,1210 and the second ends 1120,1220 of the handles. In certain embodiments, the interfacing surfaces 1140,1240 each comprise a planar surface 1141,1241 perpendicular to the drive axis 1300 wherein the planar surface 1141,1241 extends from the first ends of the handles 1110, 1210 to the second ends 1120,1220 of the handles. In alternate embodiments, as shown in FIG. 5A-FIG. 5D, a first handle 1100 and a second handle 1200 comprise interfacing surfaces 1140, 1240 comprising a helical aspect. In certain embodiments the helical aspect comprises a longitudinal twist 1145,1245 between the first ends 1110,1210 of the handles and the second end 1120,1220 of the handles. In certain embodiments the helical aspects comprise at least a 60-degree longitudinal twist 1145,1125 between the first ends 1110,1210 of the handles and the second ends 1110, 1210 of the handles. In further embodiments still, the helical aspects comprise a 90-degree longitudinal twist between the first ends of the handles 1110,1210 and the second ends 1110,1210 of the handles. In certain embodiments it may be desired for the second end 1120,1220 of the ratcheting wrenches to comprise a planar surface 1141,1142 which is parallel to the drive axis 1300 to provide increased surface area for a user's hand and thereby provide increased comfort. In certain embodiments wherein a handle comprises an oblong cross-sectional profile 1142,1142 as seen in FIG. 5D, in certain embodiments a wider aspect of the cross-sectional profiles 1142,1242 second ends 1120,1220 of the handles are oriented to be vertical or otherwise substantially parallel to the drive axis 1300.

In certain embodiments a ratcheting wrench 1000 comprising a first handle 1100 and a second handle 1200 is configured to connect directly to a threaded fastener 9000 as found with a ratcheting box wrench such as taught by the '869 Patent and Lang. A ratcheting wrench of such embodiments of the present invention comprises a first handle 1100 with a first end 1110 interconnected with a first ratcheting mechanism 1150, and a second handle 1200 with a first end 1210 interconnected with a second ratcheting mechanism 1250. The first ratcheting mechanism 1150 is coaxially interconnected with the second ratcheting mechanism 1250 along a drive axis 1300 wherein the first ratcheting mechanism 1150 and the second ratcheting mechanism 1250 are configured to rotate independently of each other. The ratcheting mechanisms 1150, 1250 comprise a drive recess 1340 comprising a hexagonal shaped, a 12-point shape, or other shape adapted for receiving a threaded fastener 9000 therein coaxially located with the drive axis 1300. To turn a fastener 9000 in a first direction, the fastener is inserted through a first end 1341 of the drive recess, and to reverse the action of the ratcheting mechanisms, a user simply inserts the threaded fastener through second end 1342 of the drive recess. The handles 1100,1200 are able to be used as a unitary handle in an aligned configuration 1030, and as independent handles in a misaligned configuration 1040. In certain embodiments the first handle 1100 further comprises an open box wrench 1500 at a second end, while alternate embodiments comprising a closed box wrench are also within the spirit and scope of the present invention.

Figure 7A:
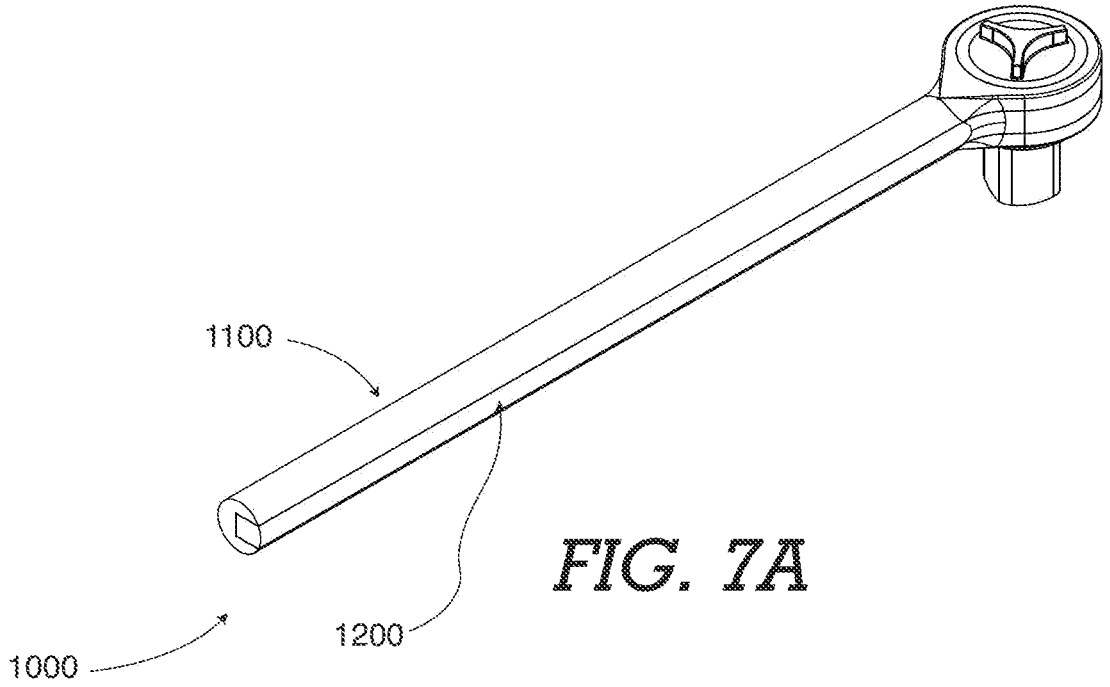
Figure 7B:
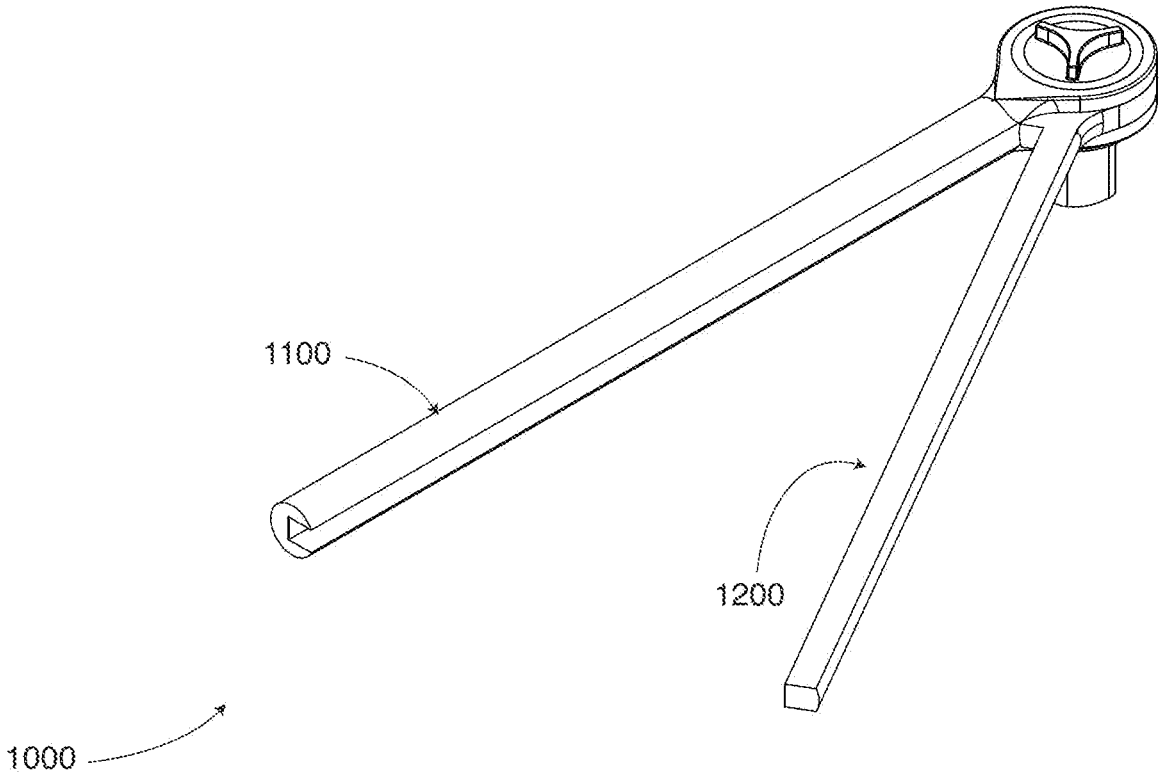
Figure 8A:
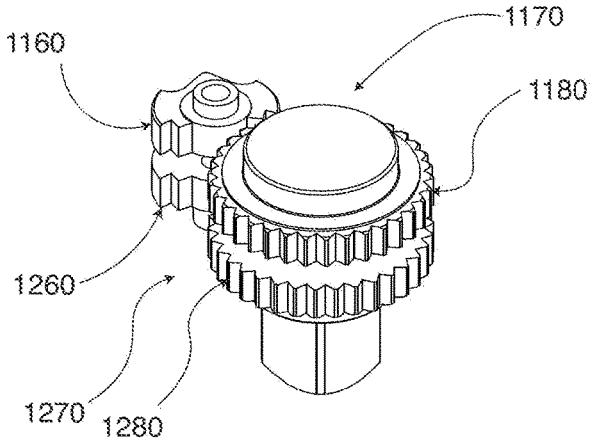
Figure 8B:
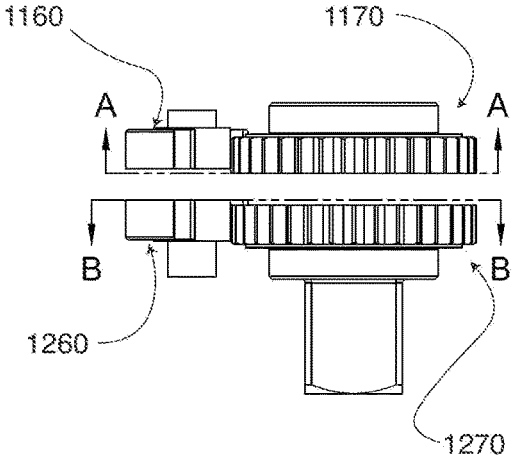
Figure 8C:
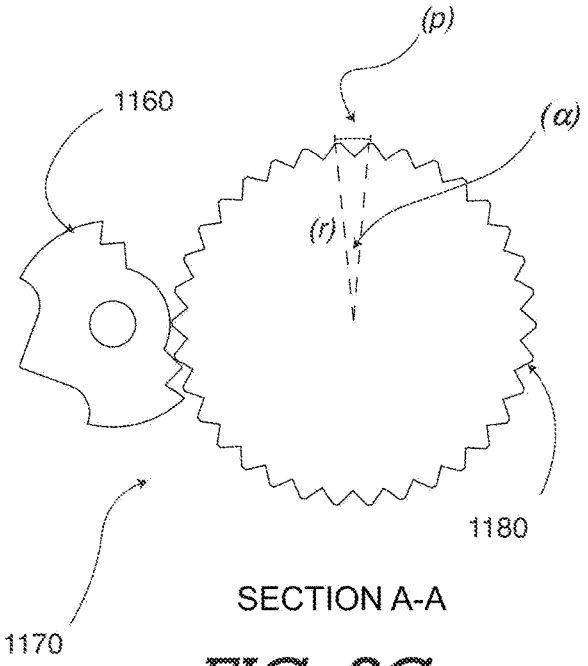
Figure 8D:
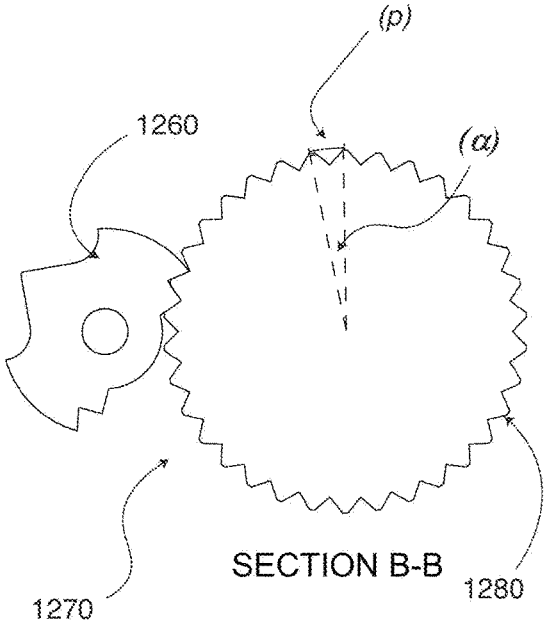

In certain embodiments, as shown in FIG. 7A-FIG. 7B, a ratcheting wrench 1000 comprises a first handle 1100 and a second handle 1200 wherein the first handle 1100 comprises a longitudinal recess 1145 configured to receive the second handle 1200 therein. Accordingly, when the handles are used in concert as a unitary handle in an aligned configuration 1030, the second handle 1200 is stowed within the recess 1145 of the first handle. As desired, the user can remove the second handle 1200 from within the first handle 1100 for use independently of the first handle 1100.

In certain embodiments of the present invention, as shown in FIG. 2A-FIG. 3B for instance, a ratcheting wrench 1000 comprises two handles 1100, 1200 and each of the two handles are interconnected with a ratcheting mechanism 1150, 1250, each comprising a geared aspect 1170, 1270. The geared aspects 1170, 1270—such as shown in FIG. 8A-FIG. 8D for instance—comprise a number (N) of gear teeth 1180, 1280. The gear teeth 1180, 1280 comprise a circular pitch (p) wherein the circular pitch is directly related to the angular engagement of the ratcheting mechanism. The ratcheting mechanism has a radius (r), and a circumference of the geared aspect is (c)—wherein (c) is the product of $2\pi(r)$ the angular engagement (a) is represented by the following expression:

$$\alpha = \frac{p}{c} \times 360$$

When the handles are in an aligned configuration 1030, the gear teeth 1180 of the first ratcheting mechanism are configured to be offset from the gear teeth 1280 of the second ratcheting mechanism by a distance of (½p). Thus, when the pawl 1160 of the first ratcheting mechanism is disengaging from a gear tooth 1180, the pawl 1260 of the second ratcheting mechanism is engaging with a gear tooth 1280. Accordingly, a new tooth 1180,1280 is engaged every (½p) distance and the circular pitch (c) is effectively reduced by half for the assembly of the first ratcheting mechanism 1150 and the second ratcheting mechanism 1250. Accordingly, the angle of engagement (α) of the ratcheting wrench 1000 is effectively reduced by half.

Figure 9A:
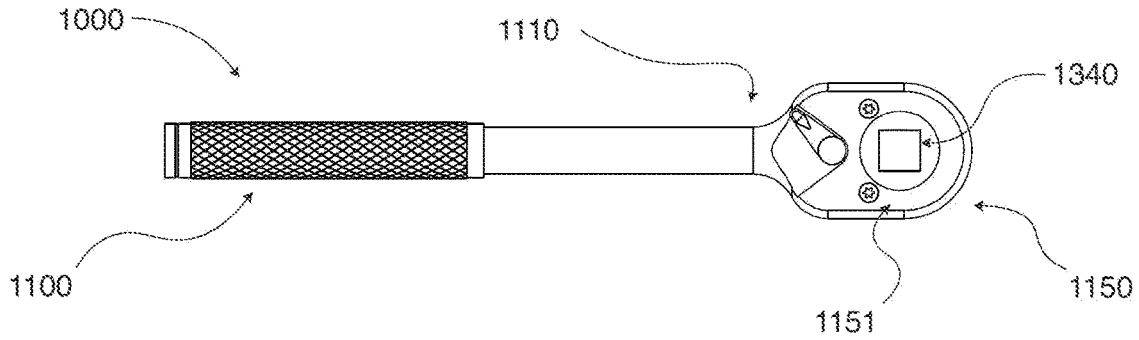
Figure 9B:
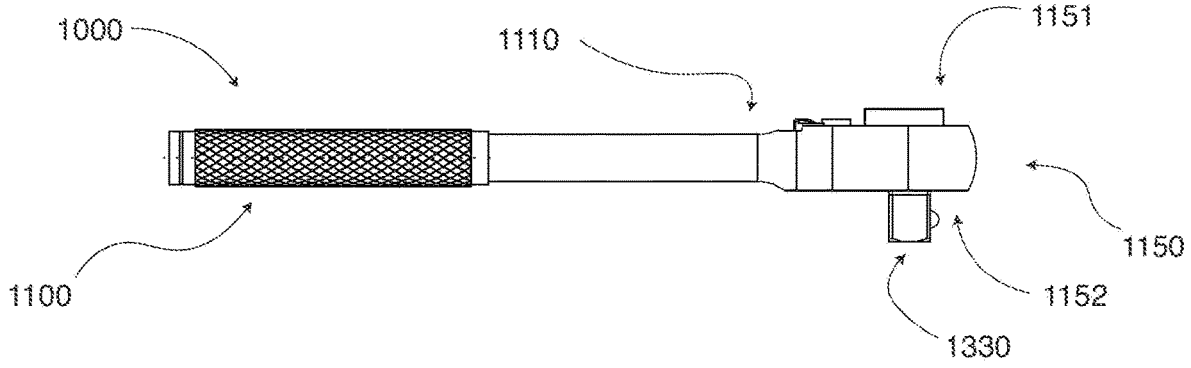
Figure 9C:
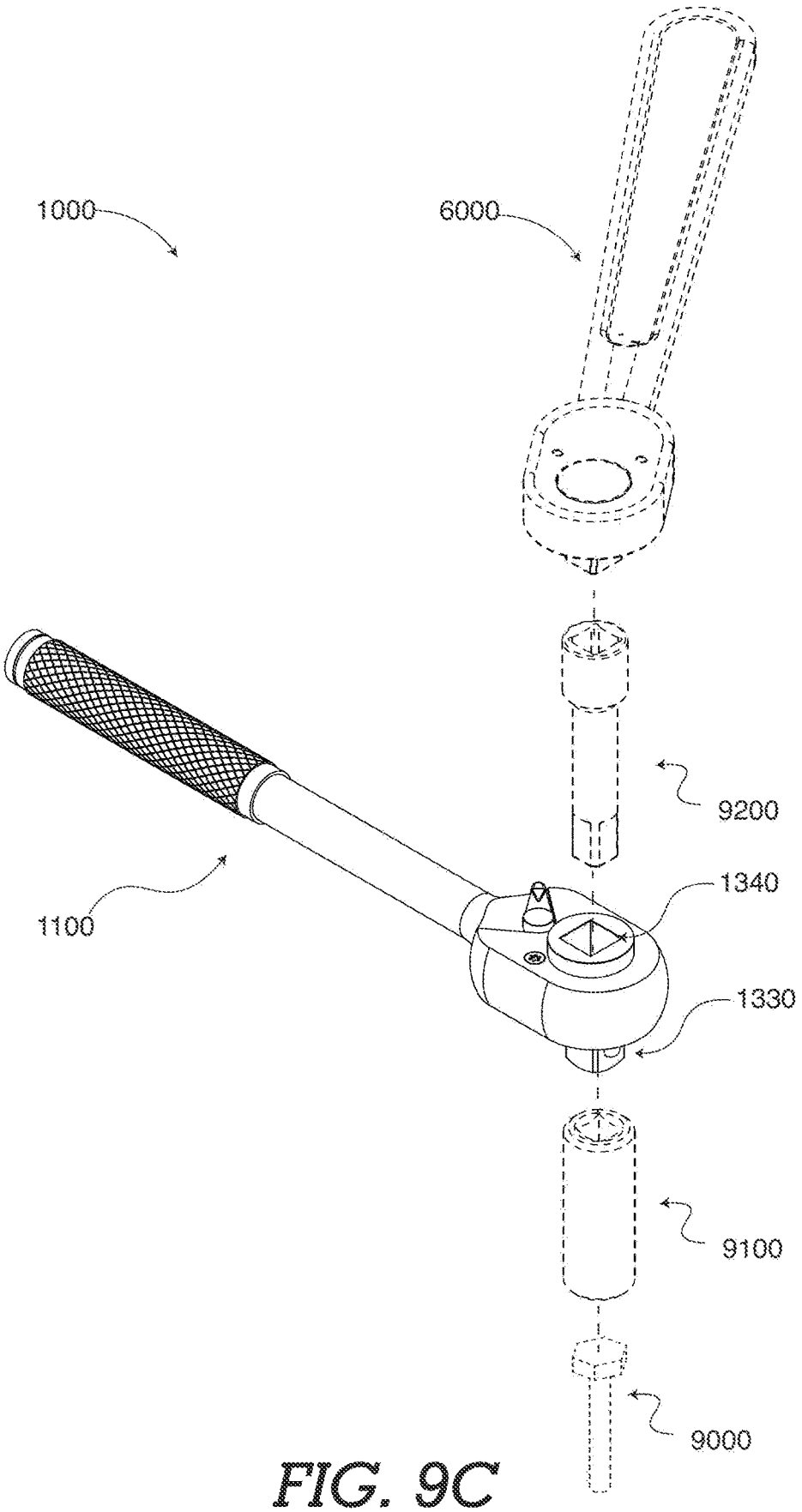
Figure 10A:
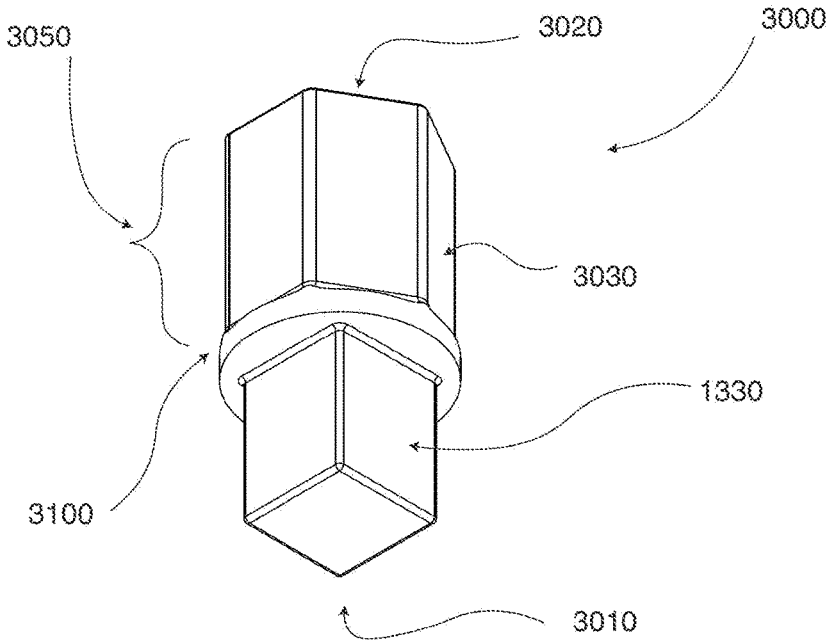
Figure 10B:
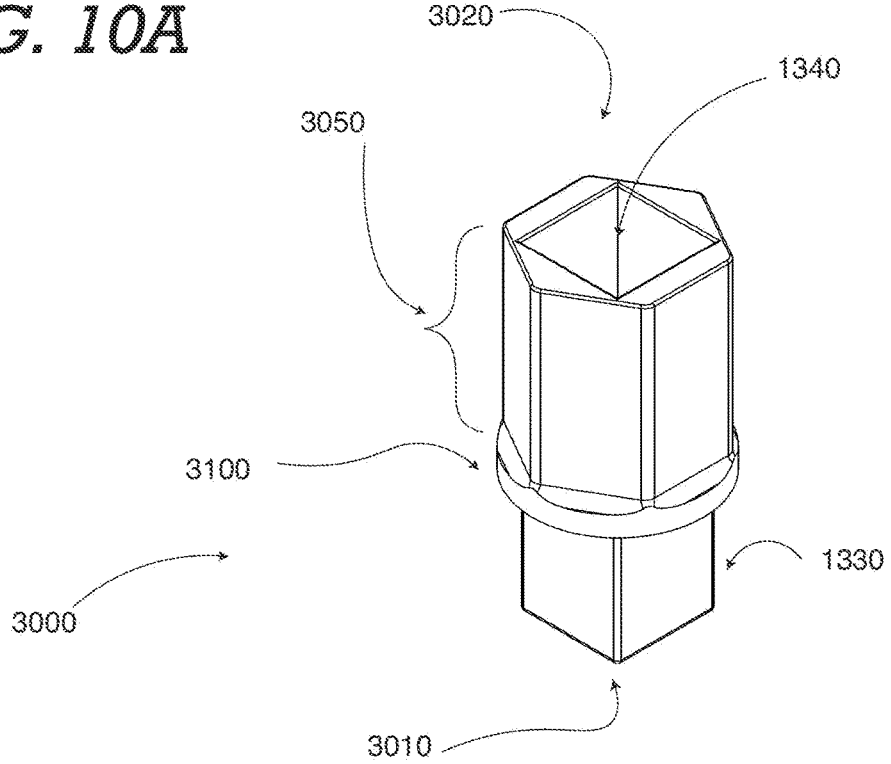

Certain embodiments of the present invention comprise a compound ratcheting wrench, as shown in FIG. 9A-FIG. 9C for instance, wherein a ratcheting wrench 1000 comprises a handle 1100 having a first end 1110 interconnected to a ratcheting mechanism 1150. In certain embodiments the ratcheting mechanism 1150 comprises a square-drive recess 1340 on a first side 1151 configured to receive a square-drive tang 6330 of an existing socket wrench 6000. The ratcheting mechanism 1150 further comprises a square-drive tang 1330 on a second side 1152 configured to interconnect with a wrench socket 9100. Accordingly, a user can interconnect the existing socket wrench 6000 to the ratcheting wrench 1000 to allow use in concert as individual handles in applying torque to a wrench socket 9100 to apply torque to a threaded fastener 9000. In certain scenarios, it may be desired to use a socket extender 9200 as shown. While embodiments shown herein comprise a socket wrench with a square-drive tang 6330 and a square-drive recess 1340, alternate embodiments comprising a ratcheting wrench 1000 with a first square-drive recess 1340 and a second square-drive recess 1340, or a first square-drive tang 1330 and a second square-drive tang 1330 are within the spirit and scope of the present invention.

Certain embodiments of the present invention comprise an adaptor 3000 having a square-drive tang 1330 at a first end 3010 adapted for interconnecting to a wrench socket 9100, a square-drive recess 1340 at a second end 3020 configured to receive a square-drive tang 6330, and a hexagonal aspect 3030 at an intermediate aspect 3050. Alternate embodiments wherein the intermediate aspect 3050 comprises a splined or lobed aspect configured to interconnect with a wrench are within the spirit and scope of the present invention. The adaptor 3000 is configured to allow the interconnection of a ratcheting box wrench 6100 and a ratcheting wrench 6000 comprising a square-drive tang 6330 thereto for use in concert. In certain embodiments, the adaptor comprises a mechanical stop 3100 between the intermediate aspect 3050 and the square-drive tang 1330 to prevent the slippage of the box wrench 6100 from the intermediate aspect 3050 toward the second end 3020.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A ratcheting wrench comprising:

a first handle having a first end interconnected with a first ratcheting mechanism, wherein the first ratcheting mechanism allows rotation between the first ratcheting mechanism and the first handle in a first direction about a drive axis, and the first ratcheting mechanism restricts rotation between the first ratcheting mechanism and the first handle in a second direction about the drive axis;

a second handle having a first end interconnected with a second ratcheting mechanism;

the second ratcheting mechanism is coaxially interconnected with the first ratcheting mechanism, wherein the ratcheting mechanisms are rotatively independent;

the second ratcheting mechanism allows rotation between the second ratcheting mechanism and the second handle in the first direction about the drive axis, and restricts rotation between the second ratcheting mechanism and the second handle in the second direction, wherein the handles can be rotated about the drive axis independently of each other in the same direction, or opposing directions in relation to each other simultaneously;

wherein in an aligned configuration, the first handle and second handle are aligned and configured for use in concert, and wherein in a misaligned configuration the first handle and the second handle are misaligned and configured for independent use;

the first handle comprises a helical interfacing surface, and the second handle comprising a helical interfacing surface configured to nest with the helical interfacing surface of the first handle when the handles are in the aligned configuration such that a second end of each handle has a planar surface extending in a major axis substantially parallel with the drive axis; and wherein the first and the second ratcheting mechanisms each comprises gear teeth that are configured to be offset when the first handle and the second handle are in the aligned configuration.

2. The ratcheting wrench of claim 1, further comprising a drive tang extending away from the ratcheting mechanism coaxially with the drive axis, wherein the drive tang is adapted for interconnecting with a wrench socket and applying a torque thereto.

3. The ratcheting wrench of claim 2, wherein the drive tang comprises a square-drive tang adapted for interconnecting with a square-drive wrench socket.

4. The ratcheting wrench of claim 3, wherein the ratcheting wrench further comprises a reversing lever, wherein when the reversing lever is in a first position, the ratcheting mechanisms allow rotation between the handles and their respective ratcheting mechanisms in the first direction, and restrict rotation between the handles and their respective ratcheting mechanisms in the second direction, and wherein the reversing lever is in a second position, the ratcheting mechanisms restrict rotation between the handles and their respective ratcheting mechanisms in the first direction, and allow rotation between the handles and their respective ratcheting mechanisms in the second direction.

5. The ratcheting wrench of claim 1, wherein at least a portion of the helical interfacing surfaces of the handles are perpendicular to the drive axis.

6. The ratcheting wrench of claim 1, wherein the helical interfacing surfaces comprise at least 60-degrees of twist between the first ends of the handles and the second ends of the handles.

7. The ratcheting wrench of claim 1, wherein the helical interfacing surfaces comprise at least 90-degrees of twist between the first ends of the handles and the second ends of the handles.

8. The ratcheting wrench of claim 1, wherein the first ratcheting mechanism comprises a quantity (N) of gear teeth, wherein the gear teeth of the first ratcheting mechanism comprise a circular pitch (p); and the second ratcheting mechanism comprising (N) teeth, wherein the teeth of the second ratcheting mechanism are configured to be offset when the first handle and the second handle are aligned.

9. The ratcheting wrench of claim 8, wherein the offset of the second ratcheting mechanism from the first ratcheting mechanism is equal to a distance of half the circular pitch (½p).

* * * * *